US006116975A

United States Patent [19]

Saito et al.

[11] Patent Number: 6,116,975

[45] Date of Patent: Sep. 12, 2000

[54] FIELD EMISSION CATHODE MANUFACTURING METHOD

[75] Inventors: Ichiro Saito; Koichi Iida; Tokiko Takahashi, all of Kanagawa, Japan

[73] Assignee: Sony Corporation, Tokyo, Japan

[21] Appl. No.: 09/301,556

[22] Filed: Apr. 29, 1999

[30] Foreign Application Priority Data

May 15, 1998 [JP] Japan ..... P10-133957

[51] Int. Cl.[7] ..... H01J 9/02

[52] U.S. Cl. ..... 445/24; 445/58; 445/50

[58] Field of Search ..... 445/24, 50, 58

[56] References Cited

U.S. PATENT DOCUMENTS

| | | | |
|---|---|---|---|
| 5,512,157 | 4/1996 | Guadagno et al. | 204/616 |
| 5,608,283 | 3/1997 | Twichell et al. | 313/309 |
| 5,836,796 | 11/1998 | Danroc | 445/50 |
| 5,947,783 | 9/1999 | Bojkov et al. | 445/51 |

*Primary Examiner*—Kenneth J. Ramsey

*Attorney, Agent, or Firm*—Ronald P. Kananen; Rader, Fishman & Grauer

[57] ABSTRACT

A field emission cathode manufacturing method is provided which comprise the steps of forming a cathode electrode on a substrate; forming an insulative layer and gate electrode, each having fine holes formed therein, in this order on the cathode electrode; thereafter immersing them in a solution in which particles of an electron-emitting substance is dispersed; and electrically depositing particles of the electron emission substance on the cathode electrode facing the fine holes by an electrophoresis using the cathode electrode as a positive or negative electrode, thereby forming an electron emitter. The wet method is adopted to form the field emission cathode, which permits to considerably reduce the plant and equipment investment and manufacture even a large-screen FED with an improved yield. Also, since the electron missive substance particles are fully exposed, a very low accuracy is allowed in producing the electron emitter. Therefore, the field emission cathode manufacturing method permits to produce a large-screen cathode plate of which the electron emission characteristic will not be deteriorated, with a greater ease and an improved yield.

9 Claims, 4 Drawing Sheets

FIELD EMISSION CATHODE MANUFACTURING METHOD

BACKGROUND OF THE INVENTION

1. Field of the Invention

The present invention relates to a method of manufacturing a field emission cathode which emits electrons under the effect of a field applied between the cathode and a gate electrode.

2. Description of Related Art

The recent researches and development of display devices have been directed for thinner display structures. In these circumstances, the so-called field emission displays (will be referred to as "FED" hereinunder) having field emission cathodes disposed therein attract special attention from various industrial fields.

The FED is a flat CRT (cathode ray tube) of a field emission type having a field emission cathode, and an anode electrode and phosphors disposed opposite the field emission cathode in a position corresponding to each pixel. The pixels are disposed in the form of a matrix to thereby build a display.

In the FED, electrons emitted from the field emission cathode are accelerated by an electric field between the field emission cathode and anode electrode and impinge upon the phosphors which will thus be excited to emit light and display an image.

The field emission cathode used in the field emission type flat CRT of this type utilizes the tunnel effect of the electrons in a strong electric field. The electron-emitting materials include a high melting-point metals such as Mo, Ni, W, etc., and Si, etc. Many of the conventional cathode chip structures are of a so-called Spindt type.

To produce a Spindt type cathode chip, a base electrode formed from a conductive layer is first formed on a substrate of glass or the like, next an insulative layer is formed on the base electrode, a gate electrode formed from a conductive layer is formed on the insulative layer, and then fine holes (of 1 $\mu$m in diameter) are formed in the gate electrode so as to reach the base electrode. Next, the above-mentioned high melting-point metal or Si is used to form a cathode chip in the hole. At this time, the lift-off technique is used to form a conical cathode-chip free end having a radius of curvature of a few tens of nm and directed towards the gate electrode.

The conical free end is less than 1 $\mu$m high and the distance between the base and gate electrodes is less than 1 $\mu$m with an insulative layer disposed between the electrodes. In the Spindt type cathode chip, when a positive electrode of a few tens of volts is applied to the gate and base electrodes, the conical free end of the cathode chip will have an electric field of about $10^7$ V/cm and emit a field of electrons.

In the field emission type flat CRT, the emitted electrons are made to impinge upon the phosphors on the anode electrode disposed opposite the conical free end of the cathode chip spaced 0.2 to 1 mm from the anode electrode. The phosphors will thus emit light.

Each of the pixels of the flat CRT consists of a few tens to a few thousands of Spindt type cathode chips. To build a display having a number of pixels (1024×768×RGB) in the XGA class being a standard specification of computer displays, for example, requires 0.1 to 100 billions of cathode chips.

The above-mentioned Spindt type field emission cathode is disadvantageous as will be described below:

Firstly, the Spindt type field emission cathode cannot be manufactured with a high yield and at a low manufacturing cost. More specifically, since the Spindt type field emission cathode has the aforementioned structure and works on the above-mentioned principle, the free end of the cathode chip is most important for concentration of electric field. For this field concentration, the free end has to be formed by the evaporation technique or the like to have a radius of curvature of a few tens of nm or less. Namely, since the working accuracy should be lower than a submicron order, similar process and equipment for manufacture of integrated circuits are required for production of the Spindt type field emission cathode. Therefore, when cathode chip group (cathode plate) is produced for a middle- to large-size screen, for example, 17 inches or more in diagonal dimension, an extremely large scale equipment and a vast plant and equipment investment are required, resulting in a considerably large increase of the manufacturing costs. Further, the cathode chips have to be produced evenly without any defect over the cathode plate surface. The larger the cathode plate size, the larger the number of cathode chips are required and the worse the yield becomes. Therefore, it is difficult to apply the Spindt type field emission cathode to a middle- to large-size screen in practice.

Secondly, the high melting-point metals Mo, Ni, W or the line and Si as the electron-emitting substances are weak against ion bombardment. They are easily deteriorated by the bombardment by the ions generated from the residual gas and phosphors. Thus, to ensure a long cathode life, the vacuum degree from this Spindt type field emission cathode must be one step or more lower than the vacuum degree for the ordinary CRT that is $10^{-6}$ to $10^{-7}$ Torr.

To solve this problem, the published document WO97/6549, for example, discloses a field emission plate or a flat CRT using the field emission plate, having a structure in which conductive particles are provided on a dielectric layer formed on a conductive layer provided on a substrate, a further dielectric layer is formed on the conductive particles and the thickness of each dielectric layer is 1/10 to 1/100 of the size of the conductive particle. The document also proposes a technique of producing the structure by printing or the like as a less expensive structure and manufacturing method suitable for manufacture of a large-screen flat display.

Further, the U.S. Pat. No. 5, 608,283 discloses a field emission cathode plate in which particles of graphite, amorphous carbon or silicon carbon are provided on high-resistance pillars formed on a conductive layer provided on a substrate or directly on the conductive layer via an adhesive layer.

In the method disclosed in WO97/6549, however, the conductive particles are provided on the conductive layer via the dielectric layer and the thickness of the dielectric layer has to be controlled to an order of a few hundreds of Å. This control is very difficult. Therefore, this method is not suitable for manufacture of a large-screen cathode plate.

Also, the field emission cathode plate disclosed in the United States Patent is characterized in that the conductive particles are bonded to the conductive layer with a conductive adhesive. However, there is a large likelihood that the conductive adhesive material is likely to cover the conductive particles. In this case, electrons will not be emitted. To avoid this, it is necessary to control the thickness of the conductive adhesive to hundreds of Å. However, this control is extremely difficult. Therefore, this method is not suitable for use to manufacture a large-screen cathode plate. Also it is difficult to dispose conductive particles selectively on the high-resistance pillars by the ordinary layer forming and printing techniques.

SUMMARY OF THE INVENTION

Accordingly, the present invention has an object to overcome the above-mentioned drawbacks of the prior art by providing a field emission cathode manufacturing method capable of producing a large-screen cathode plate with a greater ease and an improved yield.

The present invention has another object to provide a field emission cathode manufacturing method capable of producing a field emission cathode of which the electron emission characteristic will not be deteriorated.

The above object can be attained by providing a field emission cathode manufacturing method comprising, according to the present invention, the steps of:

forming a cathode electrode on a substrate;

forming an insulative layer and gate electrode, each having fine holes formed therein, in this order on the cathode electrode;

thereafter immersing them in a solution in which particles of an electron-emitting substance is dispersed; and electrically depositing particles of the electron emission substance on the cathode electrode facing the fine holes by an electrophoresis using the cathode electrode as a positive or negative electrode, thereby forming an electron emitter.

According to the present invention, the wet method is adopted to form the field emission cathode, which permits to considerably reduce the plant and equipment investment and manufacture even a large-screen FED with an improved yield.

Since the electron missive substance particles are fully exposed, a very low accuracy is allowed in producing the electron emitter. Thus, the field emission cathode manufacturing method according to the present invention permits to produce the field emission cathode with a highly improved yield and productivity and also with a greatly reduced manufacturing cost.

These objects and other objects, features and advantages of the present intention will become more apparent from the following detailed description of the preferred embodiments of the present invention when taken in conjunction with the accompanying drawings.

DETAILED DESCRIPTION OF THE PREFERRED EMBODIMENTS

First, the construction of an FED using the field emission cathode and that of each field emission cathode will be described herebelow.

Figure 1:
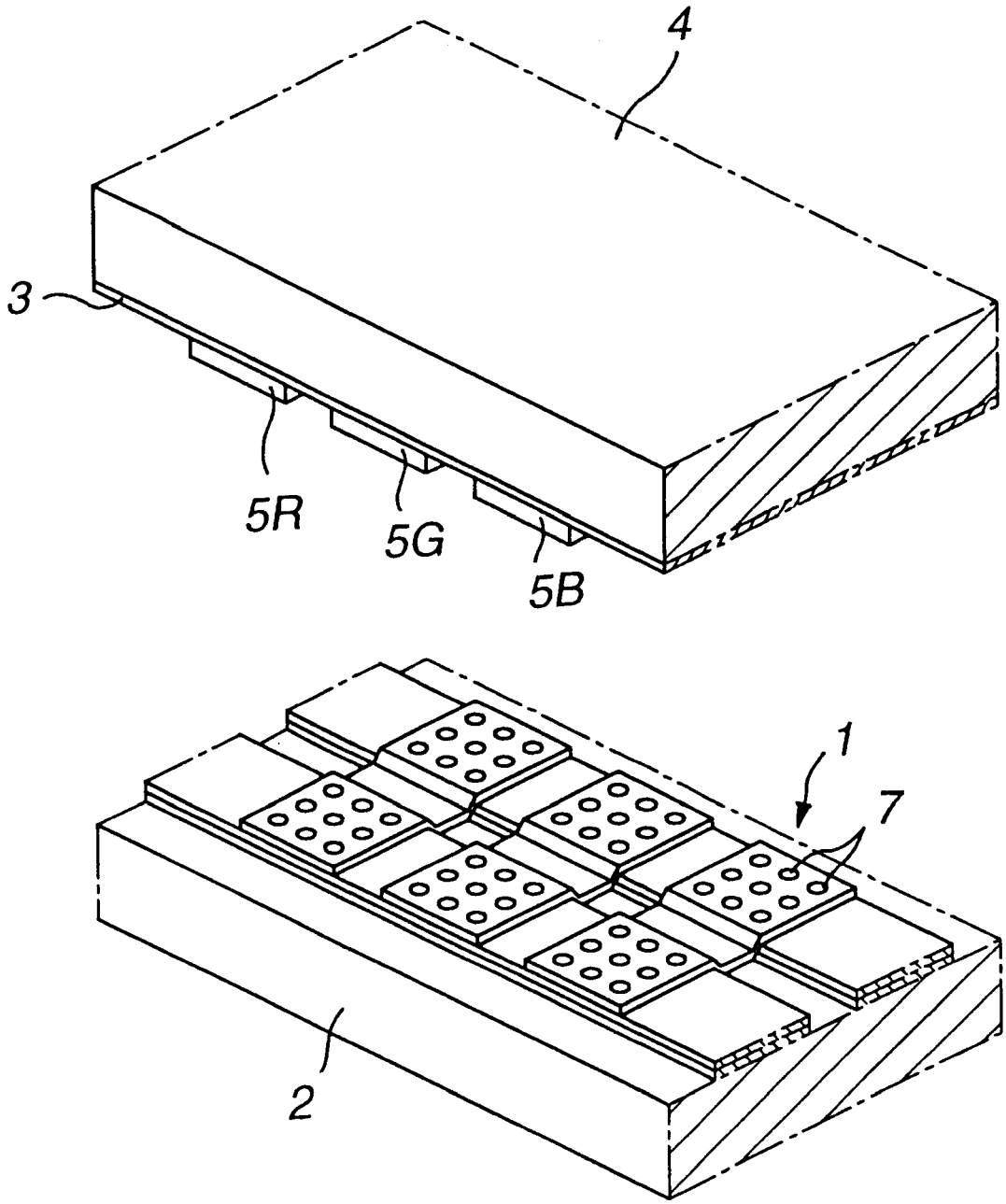
FIG. 1 is a perspective view of the essential portion of the FED according to the present invention, schematically showing the construction thereof.

Referring now to FIG. 1, there is illustrated in the form of a perspective view the essential portion of the field emission display (FED) according to the present invention. As shown, the FED comprises a back plate 2 having formed thereon field emission cathodes 1 which emit electrons when applied with an electric field, a face plate 4 disposed opposite the back plate 2 and having an anode electrode 3 formed thereon. By attaining a high vacuum between the back and face plates 2 and 4, a flat CRT of a field emission type is built. Each of the field emission cathodes 1 have a plurality of gate holes 7 formed therein.

The face plate 4 has the anode electrode 3 formed over the surface thereof, and in addition a red phosphor 5R to emit a red light, green phosphor 5G to emit a green light and a blue phosphor 5B to emit a blue light, each in a stripe form provided on the anode electrode 3. Each of intersection of phosphor stripes with the field emission cathodes 1 provides a pixel (picture element).

Figure 2:
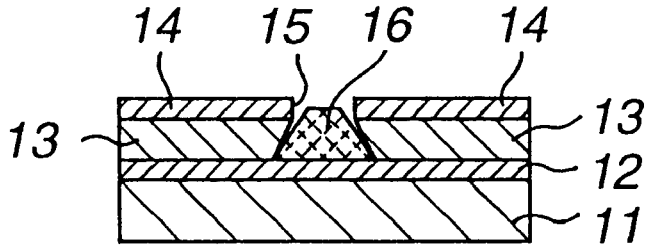
FIG. 2 is a sectional view of the field emission cathode, schematically showing the construction thereof.

On the other hand, the field emission cathode 1 comprises a substrate 11 made of glass or the like on which a cathode electrode 12, insulative layer 13 and a gate electrode 14 are formed by lamination, as shown in FIG. 2. The insulative layer 13 and gate electrode 14 have formed through them a fine hole 15 in which an electron emitter 16 is formed.

In this field emission cathode 1, when a predetermined voltage is applied between the cathode and gate electrodes 12 and 14, an electric field develops between the electron emitter 16 (equivalent to an emitter electrode) formed on the cathode electrode 12 and the gate electrode 14. Thus, the electron emitter 16 is excited by the electric field to emit electrons. That is, a tunnel current having a magnitude corresponding to the magnitude of the electric field will flow between the electron emitter 16 and gate electrode 14.

At this time, the electrons emitted from the electron emitter 16 are accelerated by a voltage applied to the anode electrode 3 and impinge on the phosphors which will thus emit a light to display an image.

In the field emission cathode 1 constructed as described in the above, the electron emitter 16 is usually formed by evaporating a high melting-point metal, Si, etc. In this embodiment, however, an electrophoresis is made of a carbon particle as electron-emitting substance particle by way of example.

Figure 3:
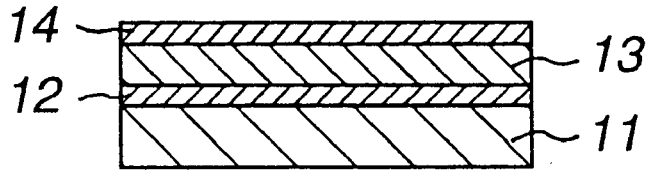
FIG. 3 is a sectional view of the field emission cathode in the process of forming the electrode.

The method of manufacturing the field emission cathode 1 will be described herebelow:

To produce the field emission cathode 1, first the substrate 11 of a soda glass or the like is prepared, a low-resistance metal layer of chromium or the like is formed on the substrate 11 by the evaporation or sputtering technique, and then the metal layer is patterned by the photoetching technique or the like to a width of 60 $\mu$m and thickness 0.5 $\mu$m, for example, to form cathode electrode 12, as will be shown in FIG. 3.

Further, the insulative layer 13 of $SiO_2$ or the like is formed by the evaporation or CVD technique to a thickness of about 0.5 $\mu$m on the cathode electrode 12, and then a low-resistance metal layer is formed on the insulative layer 13 by the sputtering technique or the like. Then the metal layer is patterned to a width of 100 μm and thickness of 0.5 μm, for example, so as to be perpendicular to the cathode electrode 12, thereby forming the gate electrode 14.

Figure 4:
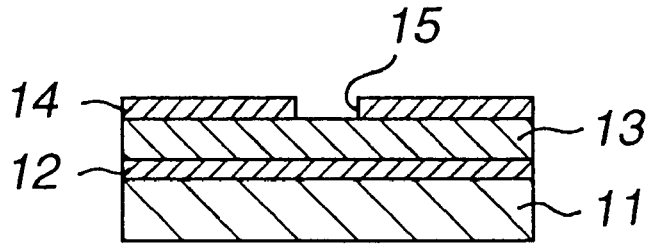
FIG. 4 is a sectional view of the field emission cathode in the process of forming a cathode hole in the gate.

Next, the photoetching technique is employed to form the cathode hole 15 in the cathode electrode 12 as shown in FIG. 4. The cathode hole 15 may be shaped to have a circular, rectangular or any other desired form. Although the cathode hole 15 may have a desired size, it has a rectangular shape of 40×80 μm in this embodiment.

Figure 5:
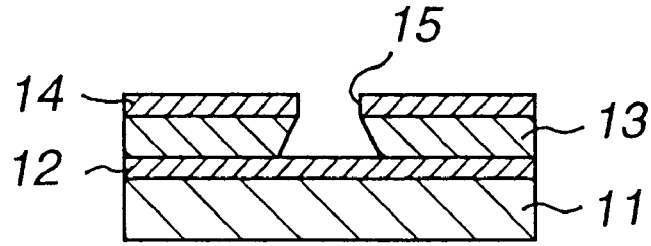
FIG. 5 is a sectional view of the field emission cathode in the process of forming the cathode hole in the insulative layer.

Thereafter, the gate electrode 14 is used as a mask to etch the insulative layer 13 in order to form the cathode hole 15 reaching the cathode electrode 12 as shown in FIG. 5

Figure 6:
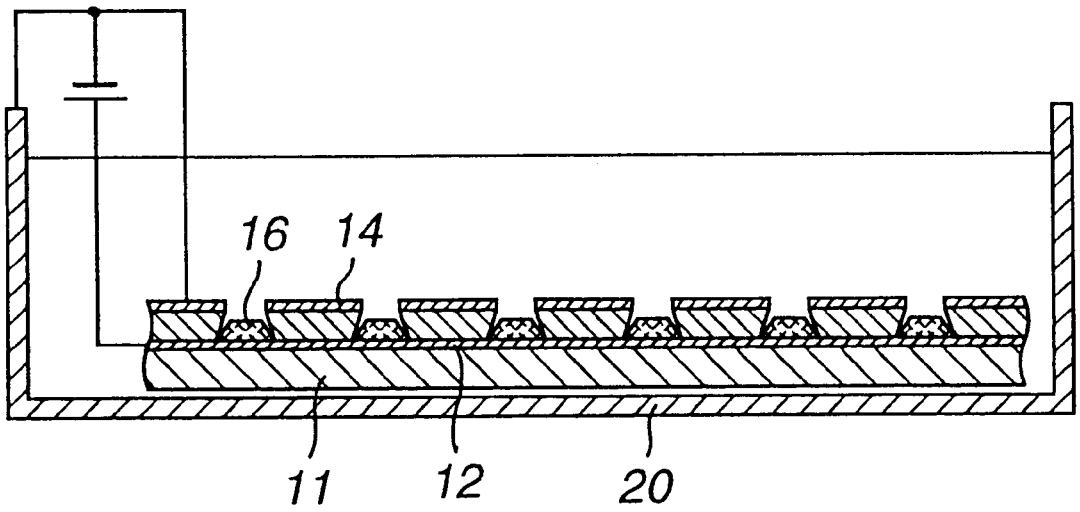
FIG. 6 is a schematic sectional view of the field emission cathode in the process of electrically depositing carbon particles on the cathode structure in an electrobath.

Further, an ammonia solution in which the carbon particles are dispersed is used as an electrolyte in an electrobath 20 made of a metal. The structure in which the cathode hole 15 is formed is immersed in the electrolyte in the electrobath 20 as shown in FIG. 6.

Note that the hydrogen ion concentration (pH) of the electrolyte is 10 in this embodiment. However, the optimum hydrogen ion concentration of the electrolyte depends upon the dispersed state of the carbon particles and thus may be set as necessary depending upon a desired dispersed state of the carbon particles.

The electrobath 20 is used as a negative electrode with reference to which a cathode electrode 12 is applied with a positive voltage while the gate electrode 14 is applied with a zero voltage, negative voltage or a positive voltage sufficiently lower than the voltage applied to the cathode electrode 12.

Thus, the carbon particles negative-charged due to the adsorption of hydroxy group ions ($OH^-$) are migrated by the electrophoresis onto the cathode electrode 12 on which the carbon particles will lose their electrons and adhere to the cathode electrode 12.

As a result, the electron emitter 16 having a tip thereof somewhat spaced from the gate electrode 14 is formed in the cathode hole 15. The electron emitter 16 thus formed does not containing adhesive or the like but is made of only the carbon particles. The carbon particles are fully exposed.

The space between the electron emitter 16 and gate electrode 14 varies depending upon the diameter, depth, shape, etc. of the cathode hole 15 and can be set as necessary. In this embodiment, the space is 5 μm.

After the electron emitter 16 is formed, the cathode 1 is washed in a purified water, and dried and baked at 50 to 500° C.

In the field emission cathode thus produced, when a voltage making the cathode electrode 12 have a negative polarity is applied between the cathode and gate electrodes 12 and 14, a portion of the electron emitter 16 opposite to the gate electrode 14 is applied with an electric field of about $10^5$ to $10^7$ V/cm and electrons are emitted from the carbon particles near the electrodes.

The cathode and gate electrodes 12 and 14 form together a matrix structure in which a pixel can be selected by selecting ones of the cathode and gate electrodes 12 and 14 to which the voltage is applied.

Figure 7:
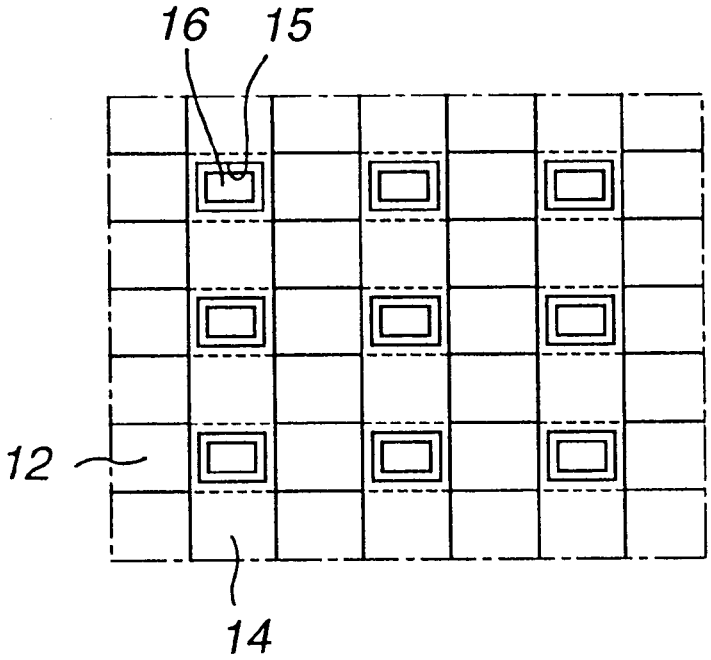
FIG. 7 is a schematic plan view of the field emission cathode having a cathode hole formed therein in a first example of shape.
Figure 8:
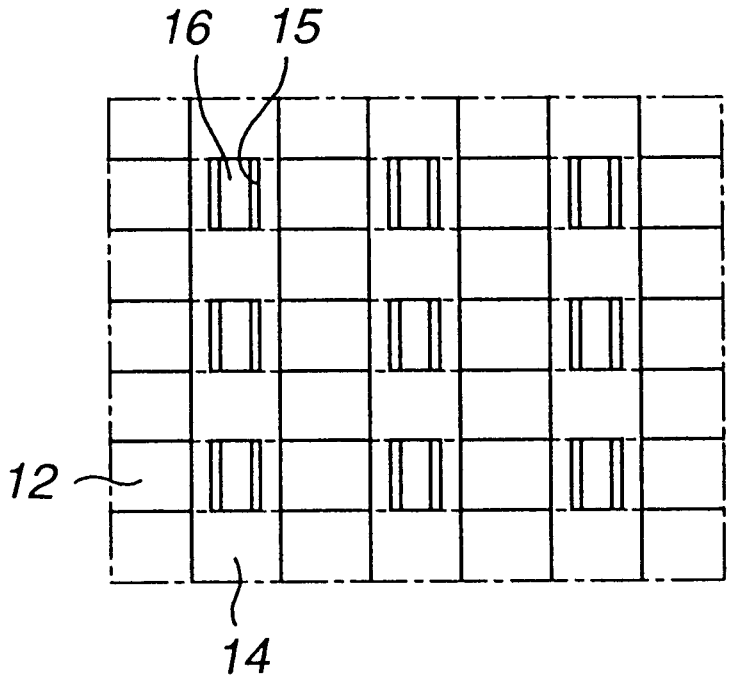
FIG. 8 is a schematic plan view of the field emission cathode having a cathode hole formed therein in a second example of shape.
Figure 9:
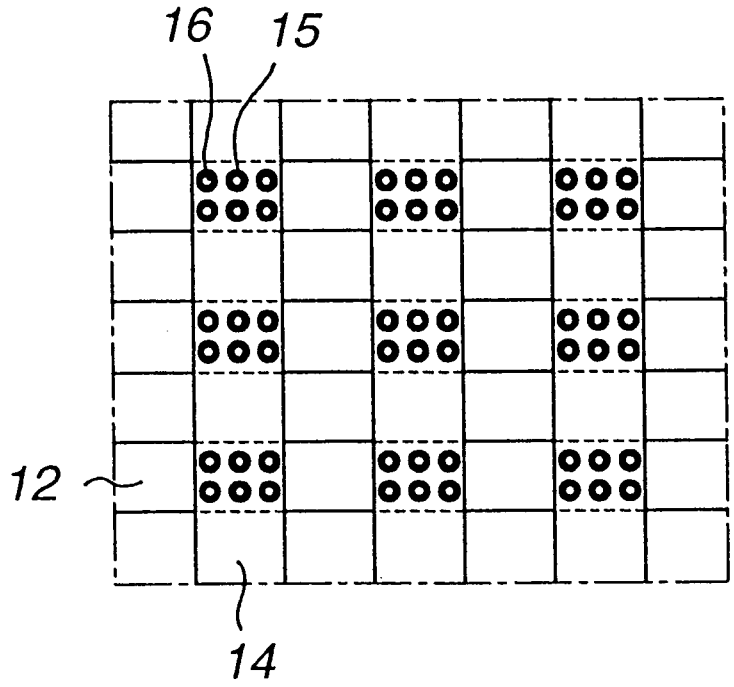
FIG. 9 is a schematic plan view of the field emission cathode having a cathode hole formed therein in a third example of shape.

The cathode hole 15 may be formed so that some portion of the intersection of the gate and cathode electrodes 14 and 12 remain along the four sides of the cathode hole 15 as shown in FIG. 7. Otherwise, the cathode hole 15 may be formed to have a slit-like shape as wide as the cathode electrode 12 as shown in FIG. 8. Moreover, the cathode hole 15 may be a plurality of round holes formed in one pixel as shown in FIG. 9. In case the cathode hole 15 is the plurality of round holes, the number of the round holes may freely be set. To average the variation of electron emission time, a few hundreds to a few thousands of such round holes may be formed as the cathode hole 15.

The process of forming the cathode hole 15 has been described by way of example. The cathode hole 15 may also be formed by a suitable one of the lift-off, photosensitive paste, screen printing and the like.

The material of the cathode and gate electrodes 12 and 14 is not limited to any special one but the electrodes may be formed from nickel, tungsten, ITO (indium tin oxide) or the like.

Further, $SiO_2$ as the material for the insulative layer 13 is just an example. The insulative layer 13 may be formed from SiO, SiN, glass or the like.

The carbon particles used to for the electron emitter 16 may be of graphite, diamond, diamond-like carbon, fullerene, carbon nao-tube or their mixture. The material of the electron emitter 16 is not limited to the carbon particles but it may be an electron-emitting substance such as conductive particles or insulative particles.

In this embodiment, the mean particle size is 4 μm. However, the present invention is not limited to this value, but a mean particle size may freely be set according to the size of the cathode hole 15 and a particle size distribution may be selected as necessary.

The dispersion medium in which the carbon particles are dispersed contains ammonia as the base in this embodiment. However, it may contain a so-called surfactant in which a hydrophilic group such as —COONa is attached to a long chain-like hydrocarbon being a hydrophobic group.

In this embodiment, the hydrophilic group may be either anionic such as $—COO^-$, $—SO_4^-$ or the like or cationic such as $—NH_3^+$.

In case the hydrophilic group is anionic, the cathode and gate electrodes 12 and 14 may be applied with a potential of the above-mentioned polarity. However, in case the hydrophilic group is cationic, the electrobath 20 is used as the positive electrode with reference to which the cathode electrode 12 is applied with a negative voltage while the gate electrode 14 is applied with a zero voltage, positive voltage or a negative voltage sufficiently lower than the voltage applied to the cathode electrode 12.

In case the dispersion medium contains a surfactant, the hydrophobic group of the surfactant is adsorbed by the carbon particles being hydrophobic (lipophilic) so that the hydrophilic group ions will cause an electrophoresis to take place. Thus the carbon particles are electrically deposited. At this time, an adjustment, if necessary, of the hydrogen ion concentration in order to maintain the dispersion, can easily be done by adding an alkaline substance such as ammonia to the dispersion medium.

To preserve the carbon particles, the solution in which the carbon particles are dispersed may be neutralized by adding an alkaline or acidic solution to the dispersion medium, and then an surfactant can be added to the neutralized solution to produce the ionized carbon particle colloid.

To further enhance the electrodeposition of the carbon particles, magnesium nitrate or the like may be added as an adhesive to the dispersion medium. When magnesium nitrate is added, an ionic reaction takes place in the dispersion medium to produce magnesium hydroxide which will act as an adhesive.

The field emission cathode produced as in the above is advantageous as will be described below:

Firstly, the sputtering or evaporation technique cannot allow the structure of carbon particles to adhere to the substrate. However, the utilization of the electrophoresis according to the present invention allows to form an electron emitter structure of carbon particles directly on the substrate.

The conventional Spindt type cathode should have an electron emitter of which the electron-emitting free end is shaped to have a radius of curvature of a few tens of nm by the evaporation technique or the like. Therefore, the working accuracy for this Spindt type cathode should be below a submicron order which would only be attainable using a similar working process and equipment to those for manufacture of integrated circuits. However, the field emission cathode manufacturing method according to the present invention permits a much lower working accuracy to form the electron emitter. Further, since the present invention adopts the wet method, the field emission cathode can be produced using less expensive manufacturing equipment and lower cost and also cathode chip groups (cathode plate) for a middle- to large-size screen.

Furthermore, the conductive carbon particles such as graphite, diamond, etc. usable in the method according to the present invention are chemically stable, and an ion bombardment to a carbon particle will only cause a new active portion to appear at the bombarded portion. Therefore, the cathode can work well in a similar vacuum to that in the ordinary cathode ray tube. Namely, no high degree of vacuum lock is required, the field emission cathode manufacturing method according to the present invention can provide a large FED.

For a cathode electrode in which the conductive particles are covered by a high-resistance layer or dielectric layer, the thickness of the high-resistance layer or dielectric layer has to be controlled, which makes it extremely different to produce the cathode electrode. According to the present invention, however, since the conductive particles are fully exposed, the binder, deposit, etc. can be completely removed by baking and the plasma etching technique or the like can be used to remove macro oxides from the surface layer of the carbon particle in order to activate the carbon particles. Therefore, the field emission cathode can easily be produced with less cost.

Also, in a cathode electrode in which the conductive particles are covered by a high-resistance layer or dielectric layer, the ion bombardment will destruct the high-resistance layer and dielectric layer, resulting in a deterioration of electron emission characteristic of the cathode electrode. Since the conductive particles are fully exposed in the cathode electrode produced according to the present invention, however, the ion bombardment will rather result in washing of the bombarded portion which will be a new active surface, so that the electron emission characteristic will not be deteriorated.

As having been described in the foregoing, the present invention provides a field emission cathode manufacturing method capable of producing, with a high yield, a large-screen cathode plate of which the electron emission characteristic will not be deteriorated.

What is claimed is:

1. A field emission cathode manufacturing method comprising the steps of:

forming a cathode electrode on a substrate;

forming an insulative layer and then a gate electrode, each having fine holes formed therein, on the cathode electrode;

thereafter immersing said insulative layer and gate electrode in a solution in which particles of an electron-emitting substance is dispersed; and electrically depositing particles of the electron emission substance on the cathode electrode facing the fine holes by an electrophoresis using the cathode electrode as a positive or negative electrode, thereby forming an electron emitter upon which said particles are fully exposed.

2. The method as set forth in claim 1, wherein the solution in which the electron-emitting substance particles are dispersed is a colloidal solution.

3. The method as set forth in claim 1, wherein the solution in which the electron-emitting substance particles are dispersed contains a surfactant.

4. The method as set forth in claim 1, wherein the solution in which the electron-emitting substance particles are dispersed contains an electrolyte.

5. The method as set forth in claim 1, wherein the electron-emitting substance particles are carbon particles.

6. The method as set forth in claim 1, wherein said fine holes are formed by lift-off, photosensitive paste, or screen printing.

7. The method as set forth in claim 1, wherein the solution in which the electron-emitting substance particles are dispersed contains ammonia.

8. The method as set forth in claim 1, wherein the solution in which the electron-emitting substance particles are dispersed contains magnesium nitrate.

9. The method as set forth in claim 1, wherein said conductive particles are covered by a high-resistance layer.

* * * * *